US009524709B2

(12) United States Patent
Carman et al.

(10) Patent No.: US 9,524,709 B2
(45) Date of Patent: Dec. 20, 2016

(54) MULTIFERROIC TRANSDUCER FOR AUDIO APPLICATIONS

(71) Applicant: THE REGENTS OF THE UNIVERSITY OF CALIFORNIA, Oakland, CA (US)

(72) Inventors: Gregory P. Carman, Los Angeles, CA (US); Paul K. Nordeen, Los Angeles, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 0 days.

(21) Appl. No.: 14/919,655

(22) Filed: Oct. 21, 2015

(65) Prior Publication Data

US 2016/0111072 A1 Apr. 21, 2016

Related U.S. Application Data

(60) Provisional application No. 62/066,839, filed on Oct. 21, 2014.

(51) Int. Cl.
*G10H 3/14* (2006.01)
*G10H 3/18* (2006.01)

(52) U.S. Cl.
CPC ..... *G10H 3/143* (2013.01); *G10H 3/18* (2013.01); *G10H 3/181* (2013.01); *G10H 2220/551* (2013.01)

(58) Field of Classification Search
CPC ..... G10H 3/146; G10H 3/181; G10H 3/143; G10H 3/18; H04R 1/46
See application file for complete search history.

(56) References Cited

U.S. PATENT DOCUMENTS 2,645,969 A * 7/1953 Daniel ..... G10H 3/09 360/130.32
2001/0028245 A1* 10/2001 Li ..... G01R 33/18 324/312
2004/0126620 A1* 7/2004 Viehland ..... H01L 41/00 360/328
2010/0005954 A1* 1/2010 Higashidate ..... G10H 3/143 84/725
2011/0001397 A1* 1/2011 Tucker ..... H01L 41/16 310/339
2015/0371623 A1* 12/2015 Gillette ..... G10H 3/181 84/726

* cited by examiner

*Primary Examiner* — Jeffrey Donels
(74) *Attorney, Agent, or Firm* — O'Banion & Ritchey LLP; John P. O'Banion

(57) ABSTRACT

A multiferroic transducer for an electrical stringed-instrument pickup comprising an upper layer and lower layer of magnetostrictive material and a middle layer of piezoelectric or ferroelectric material disposed between the upper layer and lower layer.

18 Claims, 5 Drawing Sheets

MULTIFERROIC TRANSDUCER FOR AUDIO APPLICATIONS

CROSS-REFERENCE TO RELATED APPLICATIONS

This application claims priority to, and the benefit of, U.S. provisional patent application Ser. No. 62/066,839 filed on Oct. 21, 2014, incorporated herein by reference in its entirety.

STATEMENT REGARDING FEDERALLY SPONSORED RESEARCH OR DEVELOPMENT

Not Applicable

INCORPORATION-BY-REFERENCE OF COMPUTER PROGRAM APPENDIX

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND

1. Technical Field

This description pertains generally to electrical pickups, and more particularly to multiferroic pickups for electrical string instruments.

2. Background Discussion

Electric guitar pickup and dynamic microphone pickup technology has remained relatively unchanged since the solenoid/magnet style pickup was created in the 1930's. Small advancements in coil placement and magnet types have been made over the years (e.g., the humbucking pickup in 1955). FIG. 1 shows a diagram of a single string solenoid pickup 30 and the flux lines 38 impinging on a ferromagnetic string 32. As the string 32 is moved through the magnetic flux 38 generated by the polepiece (magnet 34), a time based current $\epsilon(t)$ is produced in the solenoid.

Magnetic induction based stringed instrument pickup devices operate on the principle of Faraday's Law of induction (Eq. 1) in that a time based change of magnetic flux through a solenoid will create a proportional electromotive force through the solenoid circuit:

$$\varepsilon = -N\frac{\delta\varphi_B}{\delta t} \qquad \text{Eq. 1}$$

A typical arrangement for this type of device comprises a large copper coil solenoid 36 surrounding a collection of cylindrical permanent magnets or biased ferromagnets 34. The magnetic pole pieces 34 rest directly underneath the strings 32, which are also constructed from ferromagnetic material. The pole pieces 34 serve to direct the magnetic flux path 38 toward the individual string being detected. When the string 32 is vibrated either by manual plucking or indirect striking, the high permeability of the string 32 acts to redirect the fringing magnetic flux lines, altering the magnitude of flux through the center of the solenoid and inducing a current. This current $\epsilon(t)$ is proportional to the strings velocity and reflects its fundamental resonant mode. The current is fed into a load and often times amplified for live performance or processed for musical recordings.

The magnetic pickups incorporating the technology of FIG. 1 have several drawbacks that limit their practical use. The primary issue in using a solenoid pickup is the large coil size relative to the strings displacement during operation. To achieve the output voltage necessary for amplification, a large coil must enclose all of the magnetic pole pieces and therefore will output a concatenation of each string vibration simultaneously. String spacing on many modern electric musical instruments does not allow the necessary coil geometry for proper isolation and decoupling of individual string signals. This prevents the equalization of naturally occurring frequency and amplitude variations under the instruments operating conditions. Introduction of non-fundamental resonant modes or excessive mechanical damping is also possible if the magnetic dipole coupling force is large enough between the pole piece and the ferromagnetic string. This results in a balance between sensitivity and the introduction of harmonic distortion when designing and aligning the pickups.

With the recent expansion in the study of piezoelectric and ferroelectric materials, several guitar manufacturers have successfully integrated piezoelectric pickups into their products. Because these types of pickups transduce the vibrations transferred from the string to the body of the instrument, the signal is often times corrupted by the resonant behavior of the guitar body material and geometry. This colored tonality is often best suited for hollow acoustic style instruments which have a mechanically resonating soundboard rather than the solid non-resonant body design of many purely electric instruments.

BRIEF SUMMARY

A laminated multiferroic transducer for use as a pickup in musical instruments is described, and particularly for use in electrified stringed instruments. The technology can be used, for example, in electric guitar/bass pickups, microphone diaphragm sensors, Tonewheel and Rhodes organ pickups (tined instrument pickups), other electrified musical instruments with vibrating strings or tines. Resonant operation laminated multiferroic field sensors have been previously developed for other applications but do not provide for wideband operation such as that required by musical instruments.

In one embodiment, the laminated pickup transducer is constructed from magnetostrictive Metglas foils and PZT5H plates. The transducers were studied under dynamic magnetic field conditions over typical guitar operating frequencies (10 Hz to 15 kHz). The frequency response of the multiferroic transducers was found to be flat over the testing range when compared to a commercially available electric guitar pickup. It was found that the tri-layer transducer configuration exhibits large magnetoelectric coupling coefficients over the entire frequency range $\alpha$=21.5 V/cm-Oe at a bias field of 15 Oe.

Further aspects of the technology will be brought out in the following portions of the specification, wherein the detailed description is for the purpose of fully disclosing preferred embodiments of the technology without placing limitations thereon.

BRIEF DESCRIPTION OF THE SEVERAL VIEWS OF THE DRAWING(S)

The technology described herein will be more fully understood by reference to the following drawings which are for illustrative purposes only:

DETAILED DESCRIPTION

Figure 1:
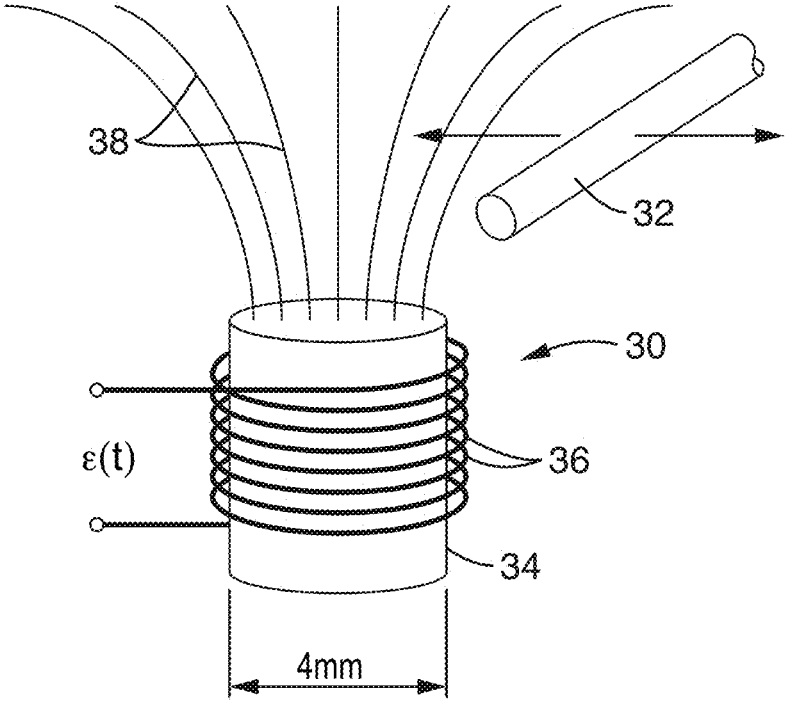
FIG. 1 (Prior Art)
FIG. 1 is a diagram of a prior art single string solenoid pickup.
Figure 2A:
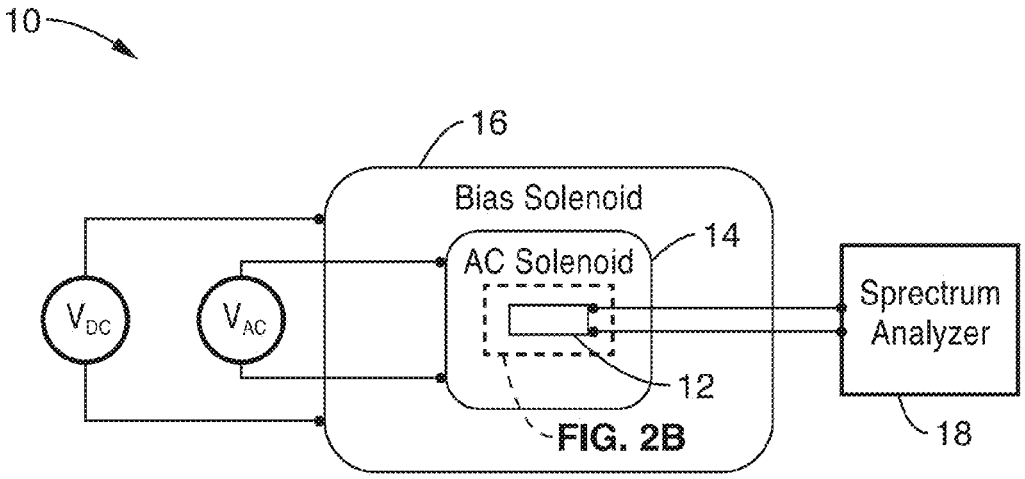
FIG. 2A is a schematic view of the concentric solenoid system used for dynamic testing of the pickup and a sample cross section of the multiferroic pickup of the present description.
Figure 2B:
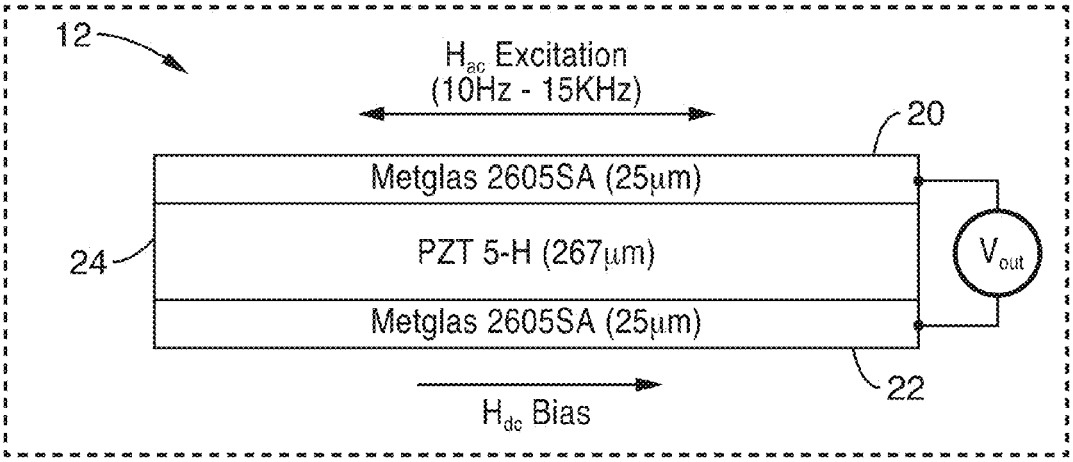
FIG. 2B shows a detailed side view of the layering schematic of the multiferroic pickup 12 of the present description.

FIG. 2A shows a schematic view of the concentric solenoid system 10 used for dynamic testing of a passive multiferroic electric stringed instrument pickup 12 in accordance with the present description. FIG. 2B shows a side view of the layering schematic of the multiferroic pickup 12.

Samples were dynamically tested inside dual concentric solenoids of system 10, wherein the outer solenoid 16 was driven with a high impedance DC voltage source and provided a uniform bias field in the plane of the sample pickup 12. A smaller multi-turn solenoid (AC coil) 14 was fabricated to fit inside of the DC coil 16 and hold the test sample pickup 12 during AC field application. The AC solenoid 14 was directly driven from the source output of a spectrum analyzer 18.

Referring to FIG. 2B, the pickup 12 is constructed as a tri-layer stack having upper 20 and lower 22 layers of a magnetostrictive foil material; and a layer of a piezoelectric material 24 between the layers of magnetostrictive foil material 20/22. In a preferred embodiment, the layer of piezoelectric material 24 is adhesive bonded to the layers 20, 22 of magnetostrictive foil material. In one embodiment, magnetostrictive layers 20, 22 comprise rapid quenched amorphous ferromagnetic alloys (e.g. iron, silicon and boron) selected for their large DC permeability. In yet another embodiment, magnetostrictive layers 20, 22 comprise Metglas 2605SA1 foils and a piezoelectric material 24 comprises a PZT5H plate.

The multiferroic material configuration 12 of FIG. 2B offers coupled electrical, mechanical and magnetic energy states and is well suited for transduction between magnetic and electrical energy required in stringed instrument pickups. The laminate materials of configuration 12, characterized a magnetostrictive material bonded to a piezoelectric or ferroelectric material, maximize the magnetoelectric coupling coefficient defined by the following Eq. 2:

$$\alpha_{ME} = \frac{\delta E}{\delta H} \qquad \text{Eq. 2}$$

where E is the electric field inside of the ferroelectric material and H is externally applied field experienced by the ferromagnet.

In a first experiment, the samples were studied under sub-resonant AC field conditions in a concentric AC excitation and DC biasing solenoid arrangement 12 of FIG. 2A with a spectrum analyzer 18 from 10 Hz to 15 KHz. The effect of bias field on the magnetoelectric coupling coefficient was examined over the sub-resonant range. The frequency response, sensitivity and optimum bias field of the laminate transducer 12 was compared to a commercially available single coil (Fender) electric guitar pickup and found to be flat. Finally the pickup was tested in a single nickel wound string configuration alongside a commercially available electric guitar pickup to compare timbres and output.

An extensional mode laminate transducer 12 was constructed from a plate 24 of PZT5H piezoelectric ceramic and amorphous Metglas foils 20, 22. PZT5H plates provide large, isotropic in-plane $d_{31}$ compressive strains when an electric field is applied along the poling direction. Double sided electrode plates 24 of 267 μm thickness PZT5H was poled in the out of plane direction using a high voltage power supply at an electric field of 0.8 MV/m held for one minute. These plates were characterized using a strain gauge measurement system and a synchronous high voltage amplifier (Trek) excited by a function generator (not shown) using a 50 MHz triangle waveform output.

Figure 3:
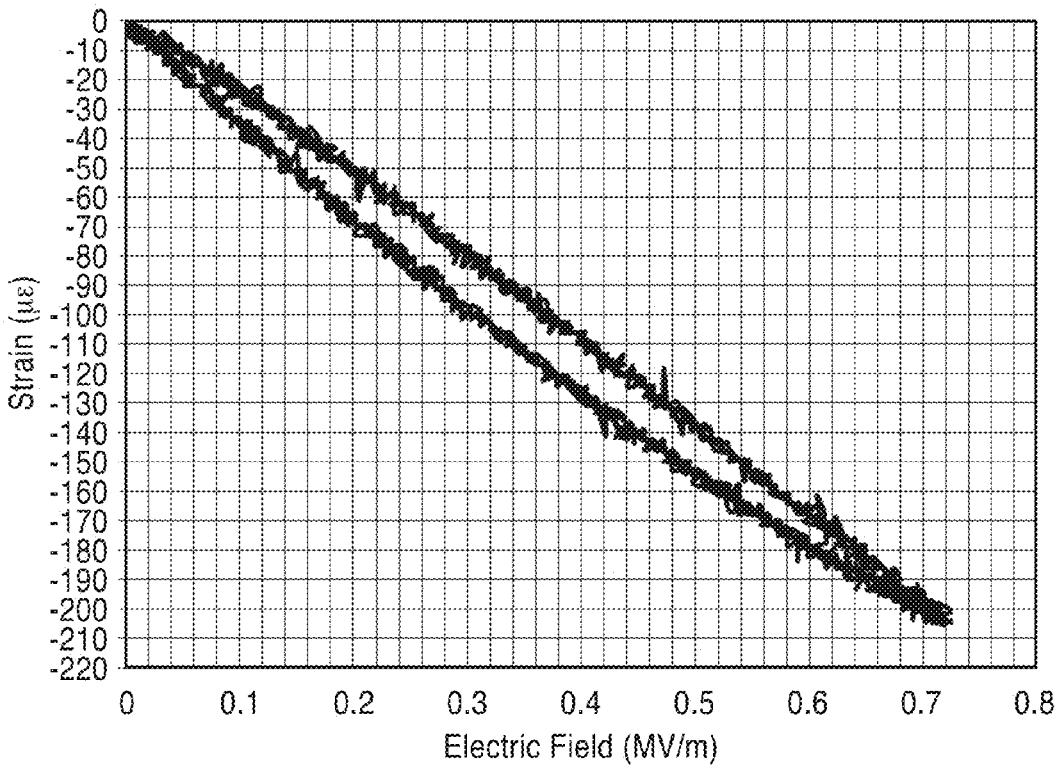
FIG. 3 is a graph showing strain versus electric field characteristic of PZT5H (Piezo Systems Inc.) plates swept from 0 MV/m to 0.72 MV/m. Coupling coefficient can be computed from a linear fit $d_{31}$=−290 pC/N.

FIG. 3 shows the in-plane strain of the piezoelectric substrate 12 as a function of applied electric field. The linear coupling coefficients can be computed from the data as $d_{31}$=−290 pC/N which is concurrent with the manufacturers quoted values (−320 pC/N). A small hysteresis is seen in the ϵ-E characteristic and is likely due to ferroelectric domain wall pinning at polycrystalline grain boundaries.

Figure 4:
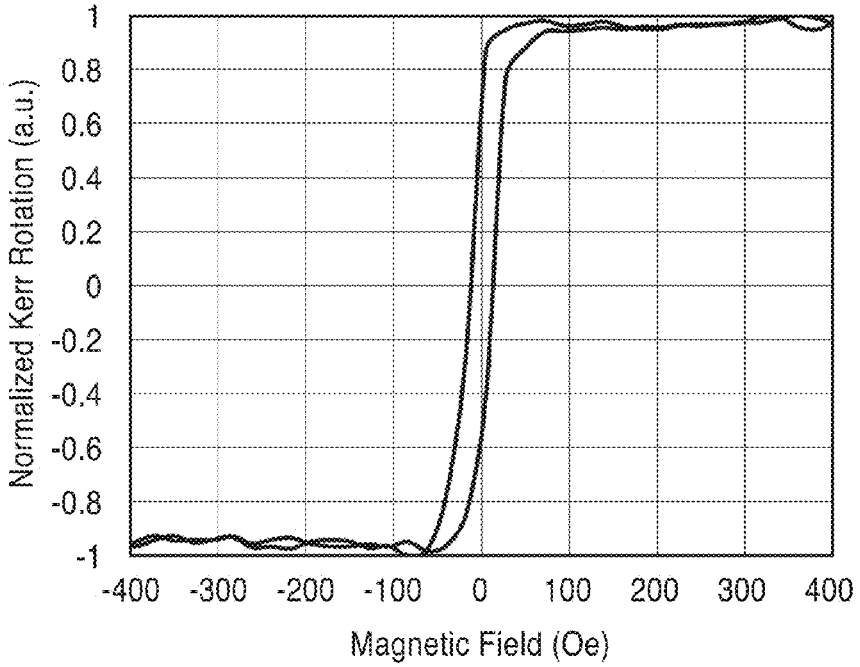
FIG. 4 is a graph showing normalized in-plane hysteresis curve for Metglas 2605SA1 foil having a thickness of 25 μm.

Metglas foils (Metglas Inc.) are a class of materials that typically has small values for saturation magnetostriction (~13 ppm) but an extremely large linear piezomagnetic coefficient ($q_{33}$=4 $Oe^{-1}$) in certain alloys. This large coupling provides for magnetostrictive sensor applications involving small excitation field magnitudes. 25 μm thin films of Metglas 2605SA1 (for layers 20, 22) were studied using a laser MOKE (Magneto Optical Kerr Effect) system by which magnetization changes are inferred from small polarization rotations in light incident upon the material. The in-plane hysteresis curve is shown in FIG. 4 as a function of applied magnetic field. The induction is normalized in arbitrary units but can be correlated to the manufacturers saturation induction value of $M_s$=1.4T. FIG. 4 indicates this alloy of Metglas is soft, with coercive field less than 10 Oe, which when coupled with a large DC permeability indicates behavior similar to superparamagnetic materials. The material also shows a small saturation field value ($H_a$~40 Oe), which establishes an upper boundary for the biasing field.

Tri-layer laminate transducers 12 were fabricated from PZT layer 24 and Metglas layers 20, 22 using a manual layup process. Each film was cut or cleaved larger than the final in plane sample dimension (usually around 5 cm square). Successive layers were manually coated in epoxy (Allied Epoxy Bond 110) and placed onto a hot plate held at room temperature. A planarized 100 g brass weight on the top surface of the sample was used to compress the layers 20, 22 and 24 together and thin the adhesive interface. The hotplate temperature was slowly ramped to a cure value of 150° C. where it is held for 10 minutes. The temperature was then slowly allowed to ramp down to room temperature. The slow ramp speed is to avoid thermal stresses which may degrade the magnetoelastic coupling. The samples were then diced to approximately 7×15 mm plates and poled using a custom high voltage power supply at 0.8 MV/m held for 1 minute.

Samples were dynamically tested inside dual concentric solenoids of the test system 10 shown in FIG. 2A. The DC coil current was monitored with an ammeter during bias field sweeps. A high impedance DC source was used to avoid any unwanted reflected loading onto the AC coil 14, which could load the source input from the spectrum analyzer 18 and give incorrect field values. The AC coil was designed such that the low impedance does not exceed the current sourcing capabilities of the function generator. The coil impedance was carefully selected and measured using an LCR meter (HP 4274A) such that the RL filter cutoff is well above the audio frequency range ($f_c$=51.1 KHz). This makes the reactive component of the coil impedance small and the coil current constant over the testing range. The AC solenoid 14 was directly driven from the source output of a Stanford Research SR785 spectrum analyzer. The output voltage of the laminate transducer 12 was detected using the spectrum analyzer high impedance input. The spectrum analyzer 18 was operated in swept sine mode from 10 Hz to 15 kHz with a 100 mVpp sine wave source output. The coils 14, 16 were calibrated using the spectrum analyzer 18 and an F.W. Bell 6010 gauss meter.

Figure 5A:
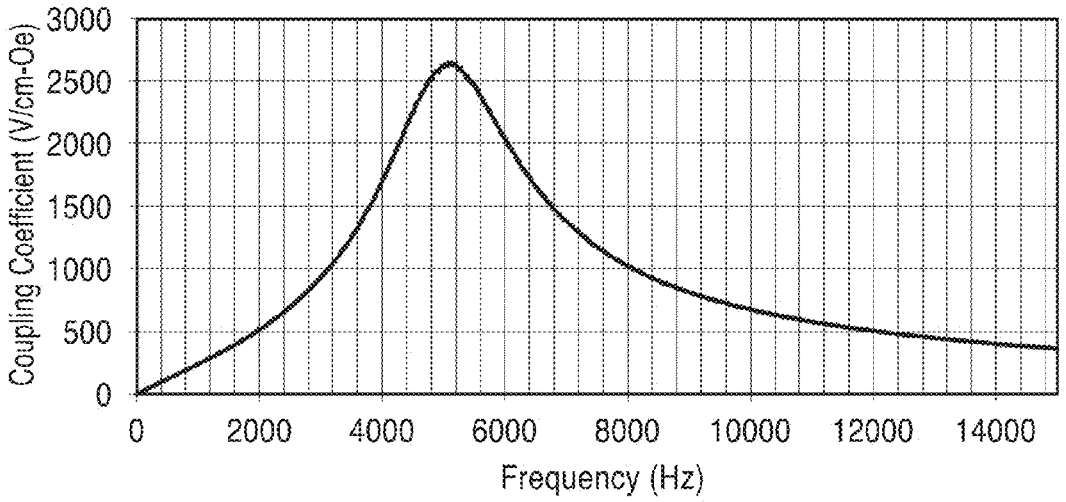
FIG. 5A and FIG. 5B are graphs showing the coupling coefficient for a solenoid type electric guitar pickup and a multiferroic transducer, respectively, at select bias fields.
Figure 5B:
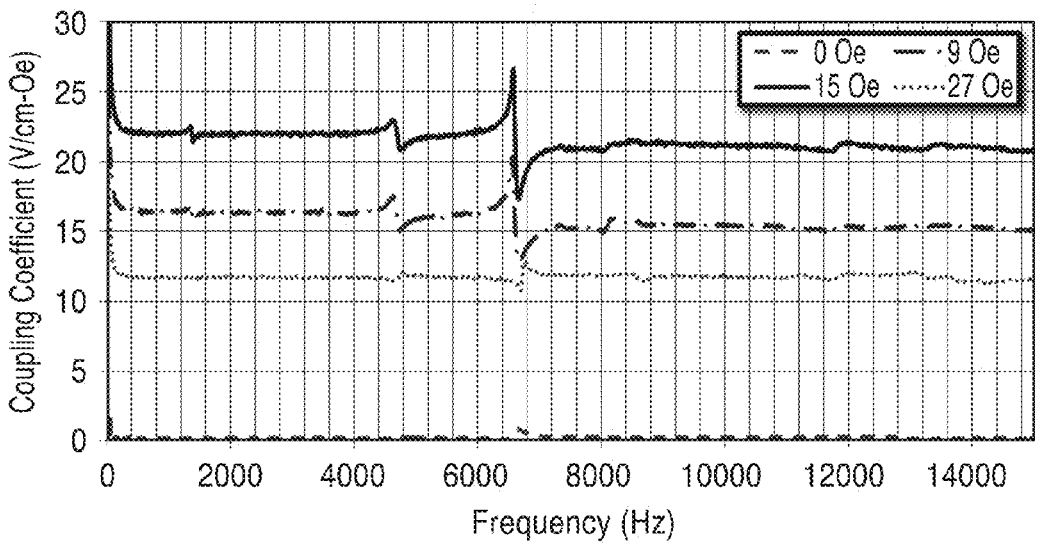

FIGS. 5A and 5B are plots showing shows the magnetoelectric coupling coefficient $\alpha$ as a function of frequency for both a commercially available electric guitar pickup (FIG. 5A) and the multiferroic transducer 12 at several bias fields (FIG. 5B) operated dynamically from 10 Hz to 15 KHz. The response of the multiferroic transducer 12 is noticeably flat in comparison to the solenoid pickup. The large inductance of the many turn coil from which the solenoid pickup 12 was constructed creates an electrical resonance around 5 KHz. This resonance is characteristic of all solenoid type electric guitar pickups and is often used by the pickup manufacturer to give the guitar its characteristic timbre. Several small peaks in the frequency response of the multiferroic pickup 12 indicate that a structural resonance is present around 6.5 KHz, which becomes larger at the optimum biasing field of 15 Oe. This resonance likely arises from a fundamental compressive resonance in the transducer 12 because of the relatively long sample dimensions used for the solenoid test system 10. In a commercial implementation, the transducer 12 dimensions can be significantly contracted to push these resonant frequencies above the range of human hearing, leaving a flat frequency response.

The magnitudes of the coupling coefficient for the electric guitar pickup displayed in FIG. 5A are likely not representative of the sensitivities achieved during actual operation. This effect arises from the additional coupling to the oscillating magnetic field generated by the AC coil 14 as well as the electric field normalization of voltage used during computation of the coupling parameter. The different transduction phenomena involved in both pickups make direct comparison of coupling present in the two systems difficult. In practice, the output voltage of the multiferroic transducer/guitar pickup 12 of the present description is marginally lower than the solenoid type pickup 30 when excited using a steel guitar string.

Figure 6:
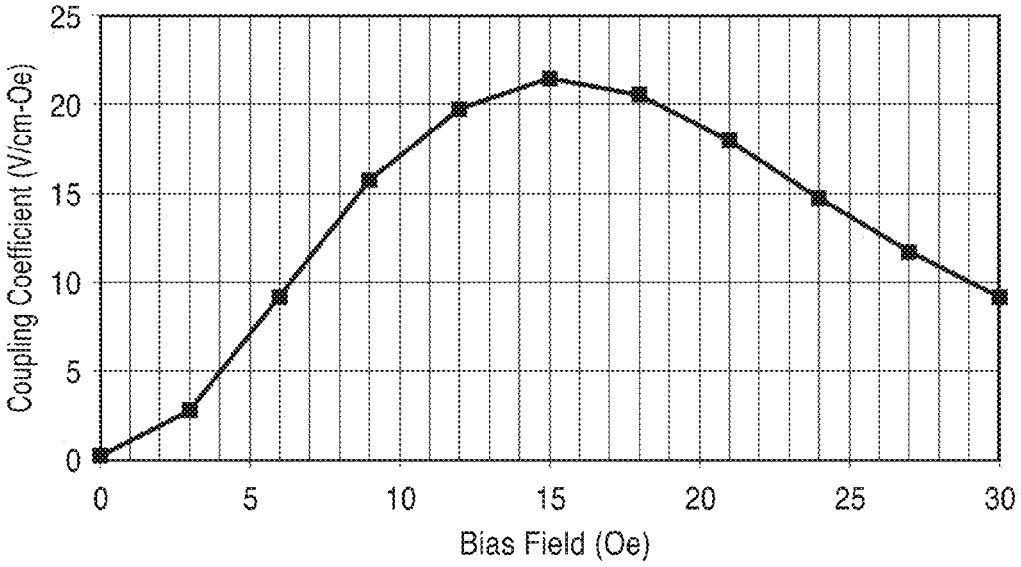
FIG. 6 is a graph showing the coupling coefficient vs. bias field for a multiferroic transducer of the present description. Values are averaged over the tested frequency range of 180 Hz to 15 KHz.

FIG. 6 is a plot demonstrating the bias field dependence of the magnetoelectric coupling coefficient of the multiferroic transducer 12. The values are averaged from 180 Hz to 15 KHz at each bias field value. The expected peak in coupling coefficient occurs at a bias field of $H_b$=15 Oe and has a value of $\alpha$=21.5 V/cm-Oe. This value compares favorably with similar devices found in literature. The coupling coefficient begins to decrease toward zero as saturation is approached. This decrease in coupling toward saturation comes from the formation of a single ferromagnetic domain which energetically becomes difficult to rotate or break into domains as a small opposing field is applied causing a reduction in magnetostriction.

From the discussion herein it will be appreciated that the new multiferroic transducer 12 for a stringed instrument signal pickup was found to address several key issues in currently used technologies.

A Metglas and PZT laminate transducer 12 was fabricated and tested under AC magnetic field conditions and found to have a large magnetoelectric coupling parameter $\alpha$=21.5 V/cm-Oe. This large sensitivity allows a simple tri-layer structure to detect steel guitar string vibrations with an output voltage comparable to that of a commercially available electric guitar pickup. The frequency response of the multiferroic transducer 12 was observed to be highly flat in comparison to current solenoid type guitar pickups 30. Furthermore, the optimum bias field in the multiferroic transducer 12 is $H_b$=15 Oe, which is an order of magnitude lower than many commercially available pickups 30 (which generally fall in the range of 80 Oe to 250 Oe). This significantly reduced bias field allows the novel multiferroic detection approach of the present description to successfully isolate individual string vibrations for independent signal processing.

It will also be appreciated that, in alternative embodiments to the configuration 12 of FIG. 2B, the present technology may include a multilayer device constructed from alternating layers of magnetostrictive and piezoelectric films, e.g. a plurality of piezoelectric layers 24 disposed between 3 or more magnetostrictive layers 20, 22 using a. Ideally the materials selected for each layer comprise large mechanical coupling coefficients. That is, the linear piezoelectric and piezomagnetic coefficients of the respective materials are selected to be as large as possible in an effort to maximize the sensitivity of the pickup. An exemplary material selection comprises Metglas ferromagnetic films and lead zirconate titanate plates or thin films, although many material systems may be used to satisfy the above requirements.

The various material layers be attached or bonded together using adhesive, eutectic or fusion bonding into a stack like structure, taking care to ensure each planar surface of the piezoelectric layers are electrically addressable. This can be done using a previously applied electrode on the piezoelectric surface or simply using the conductive properties of the magnetostrictive material (if a conductive ferromagnet is being used).

Because the multiferroic transducer 12 device operates using an interfacial strain mediated phenomena, the quality of the layer interfaces should be as high as possible. The fabricated stack of layers may be cut or diced to any number of varying geometries and sizes particular for a given application. The geometry of the stack is preferably configured to eliminate the presence of acoustic resonance in the frequency response of the transducer 12 over the desired operating range. The piezoelectric plates 24 may be poled either before laminating the layers together or after the stack is constructed, using the in situ electrode layers 20, 22. The electrodes can be electrically connected in a series or parallel arrangement depending on the desired operation characteristics.

The multiferroic transducer 12 can then be placed inside of a chassis (not shown) which secures individual transducers in a specific location and orientation with respect to a corresponding vibrating magnetic string/tine/diaphragm. For example, for a 6-string electric guitar, 6 individual multiferroic transducers 12 would be positioned with respect to each of the 6 strings. The in-plane axis of the transducer 12 plates should be oriented perpendicular to the vibrating magnetic string/tine/diaphragm to maximize the flux density change through the magnetostrictive plates, and actuate the piezoelectric plates in the d31 mode. Orientations may be configured use other transduction modes to maximize the response to the vibrating string/tine/diaphragm depending on the type of vibrating structure used and the material system chosen to construct the stack transducer. The chassis and transducer 12 assembly may or may not be potted with a compliant material such as wax to reduce microphonic vibration that may inject noise into the output signals. A biasing magnet or series of magnets (not shown) may be attached to the bottom of the transducer chassis below the transducer stacks 12. The remnant flux density of the biasing magnet(s) is chosen to maximize the magnetoelectric coupling coefficient of the transducer. Alternatively, the biasing magnet(s) could also be placed above the strings.

During pickup operation, a ferromagnetic string/tine/diaphragm 32 is vibrated above the stack transducer 12. This vibration is oriented with respect to the transducer 12 such that the largest change in magnetization in the ferromagnetic layers occurs as the string/tine/diaphragm 32 is oscillated. The coupled magnetization and strain states in the magnetostrictive layers 20, 22 cause small magnitude mechanical vibrations to occur in the transducer 12 in response to the vibrating ferromagnet. These mechanical vibrations will reflect the fundamental mode of the oscillating structure. The dynamic strain inside each magnetostrictive layer 20, 22 is transferred into the piezoelectric layer 24 through the interfaces. Because the polarization in the piezoelectric layer 24 is intrinsically coupled to the strain state, positive charge is collected on every other electrode in response to this acoustic oscillation. This charge is detected as a voltage difference across adjacent electrodes or series of electrodes.

The layers of the transducer stack 12 may also be combined in parallel to amplify the number of charges available when every other electrode is held at ground potential or in series to amplify the charge differential across the outer electrodes. These electrode potentials are then directed through electrically bonded transmission wires (not shown) to an output connector (not shown) capable of transmitting the number of transducer outputs in the instrument to the amplification or signal processing system (not shown). Alternatively, active and/or passive electronics (not shown) can be used inside the instrument for signal processing and/or pre-amplification of the individual transducer signals. The processed analog voltages can then be summed passively and/or actively and output from the instrument through a standard connector.

It will further be appreciated that transducers 12 according to the present technology produce a flat frequency response in comparison to typical solenoid/magnet type pickups. The transducers 12 can be made smaller in physical dimension than traditional solenoid/magnet type pickups, and exhibit a significantly reduced bias field magnitude at the string/tine location in comparison to traditional pickups. Furthermore, the transducers 12 may be used for individualized string detection as opposed to the summation approach of a solenoid/magnet type pickup. Additionally, the layer type structure of transducers 12 is more conducive to mass manufacturing than wound coil type pickups. Further, the transducers 12 operate on magnetic string resonance as opposed to the instruments structural resonance.

From the description herein, it will be appreciated that that the present disclosure encompasses multiple embodiments which include, but are not limited to, the following:

1. A multiferroic transducer for an electrical stringed-instrument pickup, the transducer comprising: an upper layer and lower layer of magnetostrictive material; and a middle layer of piezoelectric or ferroelectric material disposed between the upper layer and lower layer.

2. The transducer of any preceding embodiment, wherein the middle layer is bonded to the upper and lower layers.

3. The transducer of any preceding embodiment, wherein the upper layer and lower layer comprise a magnetostrictive material.

4. The transducer of any preceding embodiment, wherein the upper layer and lower layer comprise rapid quenched amorphous ferromagnetic alloys having large DC permeability.

5. The transducer of any preceding embodiment, wherein the upper layer and lower layer comprise Metglas 2605SA1 foils.

6. The transducer of any preceding embodiment, wherein the middle layer comprises a piezoelectric plate.

7. The transducer of any preceding embodiment, wherein the middle layer comprises a piezoelectric plate of PZT5H.

8. The transducer of any preceding embodiment, wherein the middle layer comprises lead zirconate titanate.

9. The transducer of any preceding embodiment, wherein the transducer has a flat frequency response ranging from about 10 Hz to about 15 kHz.

10. The transducer of any preceding embodiment, wherein over the entire frequency range from about 10 Hz to about 15 kHz, the transducer exhibits large magnetoelectric coupling coefficients 11. The transducer of any preceding embodiment, wherein the magnetoelectric coupling coefficients are equal or greater than about 21.5 V/cm-Oe at a bias field of 15 Oe.

12. The transducer of any preceding embodiment, wherein optimum bias field of the transducer is less than 100 Oe.

13. The transducer of any preceding embodiment, wherein the middle layer has a thickness of about ten times the upper and lower layers.

14. The transducer of any preceding embodiment, wherein the upper and lower layers have a thickness of about 25 μm.

15. An electrical stringed-instrument pickup, comprising: (a)

a multiferroic transducer comprising: (i) an upper layer and lower layer of magnetostrictive material; and (ii) a middle layer of piezoelectric or ferroelectric material disposed between the upper layer and lower layer; (b) wherein the a multiferroic transducer is configured to be positioned in proximity to a string or tine of an electronic instrument for individualized string detection within the instrument.

16. The pickup of any preceding embodiment, wherein the middle layer is bonded to the upper and lower layers.

17. The pickup of any preceding embodiment, wherein the upper layer and lower layer comprise a magnetostrictive foil material.

18. The pickup of any preceding embodiment, wherein the upper layer and lower layer comprise rapid quenched amorphous ferromagnetic alloys having large DC permeability.

19. The pickup of any preceding embodiment, wherein the middle layer comprises a piezoelectric plate.

20. The pickup of any preceding embodiment, wherein the middle layer comprises lead zirconate titanate.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

In the claims, reference to an element in the singular is not intended to mean "one and only one" unless explicitly so stated, but rather "one or more." All structural, chemical, and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. A multiferroic transducer for an electrical stringed-instrument pickup, the transducer comprising:

an upper layer and lower layer of magnetostrictive material; and a middle layer of piezoelectric or ferroelectric material disposed between the upper layer and lower layer;

wherein the middle layer comprises a piezoelectric plate of PZT5H.

2. The transducer of claim 1, wherein the middle layer is bonded to the upper and lower layers.

3. The transducer of claim 1, wherein the upper layer and lower layer comprise a magnetostrictive foil material.

4. The transducer of claim 1, wherein the upper layer and lower layer comprise rapid quenched amorphous ferromagnetic alloys having large DC permeability.

5. The transducer of claim 3, wherein the upper layer and lower layer comprise Metglas 2605SA1 foils.

6. The transducer of claim 1, wherein the middle layer comprises lead zirconate titanate.

7. A multiferroic transducer for an electrical stringed-instrument pickup, the transducer comprising:

an upper layer and lower layer of magnetostrictive material; and a middle layer of piezoelectric or ferroelectric material disposed between the upper layer and lower layer;

wherein the upper layer, lower layer and middle layer are sized such that the transducer has a flat frequency response ranging from about 10 Hz to about 15 kHz.

8. The transducer of claim 7, wherein the upper layer, lower layer and middle layer are configured such that linear piezoelectric and piezomagnetic coefficients of the upper layer, lower layer and middle layer maximize magnetoelectric coupling coefficients associated with the transducer; and wherein said magnetoelectric coupling coefficients are exhibited over the entire frequency range from about 10 Hz to about 15 kHz.

9. The transducer of claim 7, wherein the magnetoelectric coupling coefficients are equal or greater than about 21.5 V/cm-Oe at a bias field of 15 Oe.

10. The transducer of claim 9, wherein an optimum bias field of the transducer is less than 100 Oe.

11. A multiferroic transducer for an electrical stringed-instrument pickup, the transducer comprising:

an upper layer and lower layer of magnetostrictive material; and a middle layer of piezoelectric or ferroelectric material disposed between the upper layer and lower layer;

wherein the middle layer has a thickness of about ten times the upper and lower layers.

12. The transducer of claim 11, wherein the upper and lower layers have a thickness of about 25 μm.

13. The transducer of claim 7, wherein the a multiferroic transducer is configured to be positioned in proximity to a string or tine of an electronic instrument for individualized string detection within the instrument.

14. The transducer of claim 7, wherein the middle layer is bonded to the upper and lower layers.

15. The transducer of claim 7, wherein the upper layer and lower layer comprise a magnetostrictive foil material.

16. The transducer of claim 7, wherein the upper layer and lower layer comprise rapid quenched amorphous ferromagnetic alloys having large DC permeability.

17. The transducer of claim 7, wherein the middle layer comprises a piezoelectric plate.

18. The transducer of claim 7, wherein the middle layer comprises lead zirconate titanate.

* * * * *